United States Patent [19]

Gehring et al.

[11] Patent Number: 4,876,801

[45] Date of Patent: Oct. 31, 1989

[54] METHOD AND MEANS FOR DRYING BULK GOODS

[75] Inventors: Johann Gehring, Spardorf; Siegfried Birkle, Hoechstadt A/Aisch, both of Fed. Rep. of Germany

[73] Assignee: Siemens Aktiengesellschaft, Munich, Fed. Rep. of Germany

[21] Appl. No.: 170,906

[22] Filed: Mar. 21, 1988

[30] Foreign Application Priority Data

Apr. 16, 1987 [DE] Fed. Rep. of Germany ..... 3713069

[51] Int. Cl.[4] ..... F26B 3/00

[52] U.S. Cl. ..... 34/9; 34/37; 34/60; 34/147; 34/164

[58] Field of Search ..... 34/78, 60, 62, 66, 9, 34/179, 184, 37, 36, 164, 147

[56] References Cited

U.S. PATENT DOCUMENTS

| | | | |
|---|---|---|---|
| Re. 24,281 | 2/1957 | Jones et al. . | |
| 3,279,087 | 10/1966 | Hearne et al. | 36/36 |
| 3,386,181 | 6/1968 | Steinacker | 34/9 |
| 3,733,710 | 5/1973 | Kearney et al. . | |
| 3,982,325 | 9/1976 | Sigl et al. . | |
| 4,427,518 | 1/1984 | deVries et al. . | |
| 4,501,073 | 2/1985 | Walz | 34/9 |
| 4,696,114 | 9/1987 | Duval | 34/9 |

FOREIGN PATENT DOCUMENTS

| | | |
|---|---|---|
| 343184 | 12/1927 | Belgium . |
| 0070011 | 7/1982 | European Pat. Off. . |
| 2100098 | 3/1972 | France . |
| 2147523 | 3/1973 | France . |
| 33574 | 12/1927 | Luxembourg . |
| 741135 | 11/1955 | United Kingdom . |
| 1157651 | 7/1969 | United Kingdom . |

*Primary Examiner*—Henry A. Bennet

*Attorney, Agent, or Firm*—Hill, Van Santen, Steadman & Simpson

[57] ABSTRACT

A method and means for drying or dewatering bulk goods in which the goods are transported through a drying space by means of a helical vibrator conveyor in the presence of an insert gas. The moisture is displaced by a fluid bath contained in the drying space and consisting of a liquid which is lighter than water and is immiscible with water. A conduit is provided for eliminating the displaced moisture in the vicinity of the floor region of the drying space. The invention is particularly suited for dewatering bulk goods that are to receive electro-plated aluminum coatings with an oxygen-free, water-free aluminum-organic electrolyte.

9 Claims, 1 Drawing Sheet

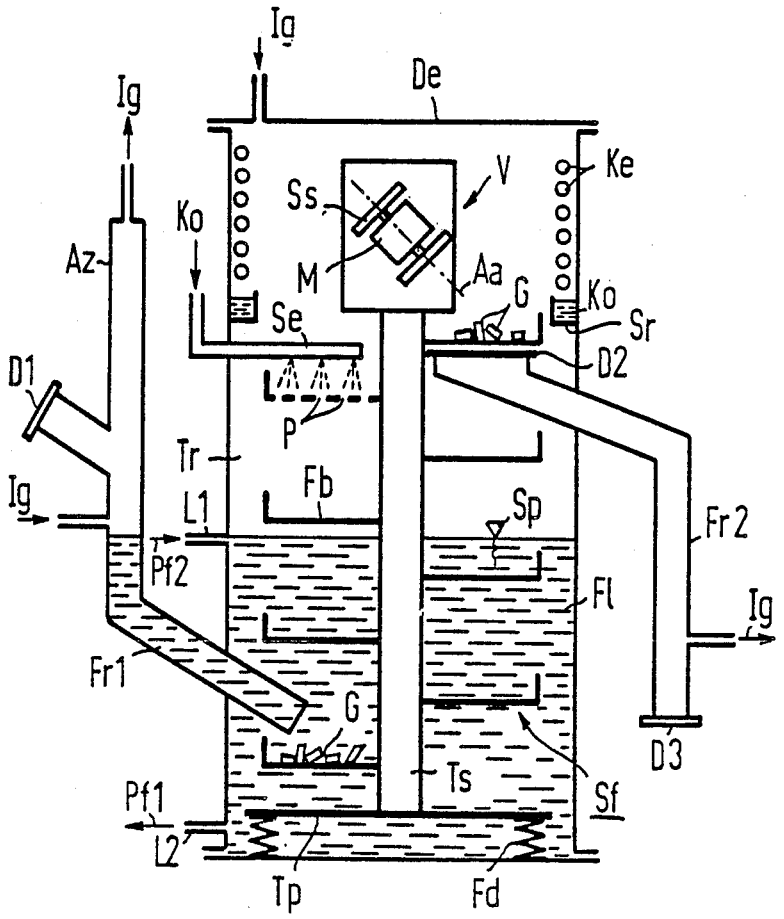
Ig
De
Ig
Ke
V
Ss
Ko
Az
M
Aa
G
Ko
Se
Sr
D2
D1
P
Tr
Fb
Ig
L1
Sp
Fr2
Pf2
Fl
Ig
Fr1
G
D3
Ts
Sf
Pf1
L2
Tp
Fd

METHOD AND MEANS FOR DRYING BULK GOODS

BACKGROUND OF THE INVENTION

1. Field of the Invention

The present invention is directed to a means for drying bulk goods, particularly for pre-treatment of such goods for subsequent deposition of aluminum in an aprotic, oxygen-free and water-free aluminum-organic electrolyte. It comprises a helical vibrator conveyor for transporting the goods through a drying space containing a water immiscible liquid whereby the moisture adhering to the goods is displaced and is eliminated.

2. Description of the Prior Art

The present invention is directed to drying of bulk goods, which refers to the elimination of moisture adhering to bulk goods, and in particular, to a dewatering of the bulk goods. Such a drying has been undertaken, for example, in what are referred to as dry boxes which are heated electrically, or with gas, or with steam, the boxes having a plurality of perforated transverse walls of sheet metal lying above one another in spaced layers. Openings through which warm, humid air can be withdrawn are located at the top of the dry box. In mass electroplating of bulk goods, the electroplating devices are also frequently followed by drying means wherein the withdrawal of moisture is undertaken either by hot air or by fluorinated hydrocarbon baths supplemented with ultrasound generators.

U.S. Pat. No. 3,733,710 discloses a drying means of the type described wherein a fluid is contained in the drying space, the fluid being heavier than water and displacing the moisture adhering to the bulk goods toward the bath surface. The water collecting at the bath surface can then be withdrawn at the outside of the bath. The utilization of vibrator conveyors as the conveying element permits an extremely gentle conveying of the bulk goods, so that a jamming up of a conveyed goods is essentially prevented. Furthermore, the oscillations and vibrations occurring during the conveying of the bulk goods have a very positive influence on the drying process.

Aluminum deposited from an aprotic, oxygen-free and water-free aluminum-organic electrolyte is distinguished by its ductility, its low number of pores, resistance to corrosion, and ability to be anodized. Since access to air effects a considerable diminution in the conductivity and in the useful life of these electrolytes due to reaction with atmospheric oxygen and atmospheric humidity, the electroplating must be done in an electroplating device provided with means for excluding air. To prevent access to air during loading and unloading, the electroplating device requires inward transfer and outward transfer locks in the form of gas locks or liquid locks or as combined gas-liquid locks and equipped with conveying means for passing the goods for electroplating therethrough. For example, European Patent A 0 070 011 discloses an aluminum plating device for mass electroplating of bulk goods which operates under conditions of air exclusion and is provided with inward transfer and outward transfer locks.

Aluminum plating using an aprotic, aluminum-organic electrolyte requires a particularly careful dewatering of the goods to be aluminum plated. Thus, following a pre-treatment in aqueous baths, the moisture adhering to the goods to be electroplated must be eliminated without leaving a residue insofar as possible so that the conductivity and the useful life of the aluminum-organic electrolyte are not deteriorated. Moreover, neither atmospheric oxygen nor atmospheric moisture can be carried into the aluminum plating device together with the goods to be plated.

SUMMARY OF THE INVENTION

The present invention provides an improved drying for bulk goods. In particular, the system is designed to provide an effective dewatering of the bulk goods which should be able to satisfy the prerequistes for subsequent electro-deposition of aluminum from aprotic, oxygen-free and water-free aluminum-organic electrolytes.

In keeping with the present invention, the drying space is closed gas-tight and is charged with an inert gas. The liquid contained in the drying space has a specific gravity lighter than water and the moisture displaced by the liquid can be diverted toward a discharge from the floor region of the drying space.

In the drying system of the present invention, the bulk goods are conveyed through a drying space which is gas-tight and into which an inert gas is charged. The goods are conveyed through the space by means of a helical vibrator conveyor. Without coming into contact with air, the dried goods are then immediately introduced into a subsequent treatment device by means of an inward transfer lock. The drying means of the present invention is therefore especially suited for a subsequent electro-deposition of aluminum from an aprotic, oxygen-free and water-free aluminum-organic electrolyte to eliminate water accumulated from an aqueous pre-treatment of the goods. The system of the present invention can also be used in other phases of electroplating technology such as drying processes preceding or following the electroplating, wherein the moisture to be eliminated may be composed, for example, of aqueous pre-treatment or after treatment baths, electrolytes, or other fluids. A drying process other than in the field of electroplating technology such, for example, as in the metallization of bulk goods in a vacuum, the application of lacquer layers or other protective coatings can likewise be improved by means of the drying devices of the present invention. Furthermore, the use of the drying devices of the invention can also recover the moisture adhering to the bulk goods or prevent the emission of this moisture to the environment.

The use of a liquid which is lighter than water in the drying space has a significant influence on the quality of the drying or dewatering. The moisture adhering to the bulk goods is displaced during conveying through the liquid, whereupon it sinks to the floor of the drying space and can be diverted from there to the outside. A drying profile arises in the drying space which guarantees a progressive drying of the material with increasing conveying distance toward the top through the liquid. When they leave the liquid, the bulk goods then enter into an inert gas atmosphere without coming into contact with the displaced moisture in the boundary region.

In a preferred embodiment of the invention, saturated hydrocarbons or cycloparaffins or aromatic hydrocarbons are employed in the drying space as the drying liquid. Such liquids are lighter than water and are especially well suited for displacing moisture or water.

It is also advantageous in view of the desired drying profile that at least the lower flights of the helical vibratory conveyor be arranged under the surface of the liquid contained in the drying space.

According to a further, preferred embodiment of the invention, the conveyor flights are provided with perforations at least in certain areas. The fluid exchange in the region of the material to be dried is thereby promoted under the surface of the bath, whereas the liquid still adhering to the material can drip off better but can be spun off better above the surface of the bath. It is thus expedient that the conveying path of the vibratory conveyor extend above the surface of the liquid contained in the drying space.

It is also possible to provide a spraying means for spraying a liquid at least in the terminal region of the conveying path of the vibratory conveyor, so that the liquid rinses off residual moisture possibly still adhering to the goods. The condensation means may be provided in the space above the surface of the liquid bath, and the condensate accumulating in the condensation means can be returned to the spray device. The same liquid that displaces the moisture in the bath is thus used as the spray fluid. Since the bath is heated by an internal heating device or is externally heated in circulation, vapors arising from the bath also effect an additional rinsing of the residual moisture that may still adhere to the goods.

BRIEF DESCRIPTION OF THE DRAWINGS

The single drawing illustrates a longitudinal section through a tower-shaped drying means for bulk goods such as bolts, nuts, screws, bushings, and the like.

DESCRIPTION OF THE PREFERRED EMBODIMENTS

The drying of the goods G takes place in a drying space Tr which can be made gas-tight by means of an upper cover De, the drying space Tr being charged with an inert gas such as nitrogen, the supply of the inert gas being indicated by an arrow Ig.

The goods G to be dried are introduced into the lower region of the drying space Tr by means of a down pipe Fr1, whereby the down pipe Fr1 provides a gas lock that can be closed at the entry side by a cover D1. The feed of inert gas into the down pipe Fr1 and the discharge of the inert gas out of a vertical branch Az of the down pipe Fr1 is indicated by arrows Ig.

The bulk goods G introduced by means of the down pipe Fr1 fall into the lower end of a vibratory conveyor including flights Fb, the conveyor being arranged inside the drying space Tr and is referenced Sf overall. The goods G are transported upwardly by the helical conveyor and then fall into the upper end of a down pipe Fr2 which leads out of the drying space Tr, the upper end being shaped in the nature of a funnel and closable with a cover D2. The down pipe Fr likewise functions as a gas lock and is closable by a cover D3 at its exit side. The down pipe Fr is rinsed with the inert gas entering into the drying space Tr, the discharge of the inert gas being indicated by an arrow Ig. The down pipe Fr2 can be followed by a pretreatment device having a water-free treatment bath, by a liquid lock, or, alternatively, can be directly fed to a aluminum plating system.

The conveying flights Fb leading helically up inside the drying space Tr are secured to a centrally positioned column Ts whose lower end is vibrationally seated on the floor of the drying space Tr by means of a bearing plate Tp and a plurality of springs Fd whose upper end carries a vibrator V. The vibrator V has a motor M that drives eccentric disc fly wheels Ss ranged at both sides thereof. The drive shaft Aa of the motor M is inclined by an angle of, for example, 45° relative to the horizontal so that the imbalance of the disc fly wheels Ss generates vibrations with the somewhat helical movement of the vibrator V of the carrying column Ts. As a result of the skewed movement and the accelerations and velocities which occur, the goods G lying on the conveying path have an oblique throw forced on them, and the goods G are transported up in the conveying direction. Since the lateral throw and the height of the throw are extremely slight, this type of conveying involves a system which guarantees an extremely gentle treatment of th goods G.

A non-aqueous fluid F1 which displaces the moisture adhering to the goods is situated in the drying space Tr up to the level of the surface Sp. The displacement effect is greatly promoted by the vibrations of the goods G and is promoted to a certain extent by the perforations P appearing on the conveying flights Fb as well. The perforations P are only indicated at one location in the drawing. Since the liquid F1 is lighter than water, the water displaced by the fluid F1 can be diverted toward the outside from the floor region of the drying space Tr by a conduit L1, as indicated by an arrow Pf1. As required, the liquid F1 can be replenished from outside the vessel in the region of the surface Sp by means of a conduit L1, as indicated by an arrow Pf2.

Above the surface Sp of the fluid F1, residual moisture that still may be adhering to the goods G can be rinsed off with a spray means Se that is indicated generally in the drawing. The spray fluid that is used is acquired from the liquid F1 contained in the drying space Tr. The liquid F1 is externally heated in circulation, or is directly heated by a heater arranged in the drying space Tr, and heated to such a degree that the liquid F1 partially evaporates and in turn condenses in a cooling means Ke arranged in the upper region of the drying space Tr. The condensate Ko formed by the cooling means Ke is collected in a collecting trough Sr and is applied to the spray device Se by means of a pump which is not shown in the drawing. The drying process is additionally greatly promoted in that the vapors arising from the liquid F1 come into contact with the goods G in the region above the surface Sp.

The liquid F1 contained in the drying space Tr is an organic liquid that is immiscible with water and should be lighter than water. These requirements are met by saturated hydrocarbons (normal straight chain and branch chain isomers of higher hydrocarbons), cycloparaffins, and aromatic hydrocarbons. It is also advantageous to use a solvent which evaporates very quickly. In aluminum electroplating wherein a completely dry surface is not strictly required, hydrocarbons having a higher boiling point can also be employed. The important thing is that there be a complete displacement of the water from the surface of the bulk goods G.

Examples of suitable fluids F1 of the aforementioned classes of substances are given in the following tables.

| Normal Hydrocarbons | Boiling Point Degrees C. | Specific Gravity |
|---|---|---|
| n-pentane | 36.1 | 0.6264 |
| n-hexane | 68.7 | 0.6594 |
| n-heptane | 98.4 | 0.6837 |
| n-octane | 125.6 | 0.7028 |
| n-nonane | 150.7 | 0.7179 |
| n-decane | 174.0 | 0.7298 |

-continued

| Isomers | Boiling Point °C. | Specific Gravity |
|---|---|---|
| 2-methylpentane | 60.3 | 0.654 |
| 3-methylpentane | 63.3 | 0.676 |
| 2,2-dimethylbutane | 49.7 | 0.6487 |
| 2,3-dimethylbutane | 58.0 | 0.668 |
| 2-methylhexane | 90.0 | 0.679 |
| 3-methylhexane | 92 | 0.687 |
| 2,2-dimethylpentane | 78.9 | 0.674 |
| 2,3-dimethylpentane | 89.7 | 0.695 |
| 2,4-dimethylpentane | 80.8 | 0.673 |
| 3,3-dimethylpentane | 86.0 | 0.693 |
| 3-ethylpentane | 93.3 | 0.698 |
| 2,2,3-trimethylbutane | 80.8 | 0.690 |
| **Cycloparaffins** | **Boiling Point °C.** | **Specific Gravity** |
| cyclopentane | 49.5 | 0.7460 |
| cyclohexane | 80.8 | 0.7781 |
| cycloheptane | 117.0 | 0.8100 |
| cyclooctane | 147.0 | 0.8304, melting point 14° C. |
| **Aromatic hydrocarbons** | **Boilinq Point °C.** | **Specific Gravity** |
| benzene | 80.1 | 0.879 |
| toluol | 110.6 | 0.867 |
| o, m, p-xylene | 144–138 | 0.861–0.880 |
| mesitylene | 165 | 0.865 |
| ethylbenzene | 136 | 0.867 |
| cumene | 152 | 0.862 |
| p-cymene | 177 | 0.855 |

In view of the toxicity of the aromatic hydrocarbons, liquids of the paraffinic type are preferred.

It should be evident that various modifications can be made to the described embodiments without departing from the scope of the present invention.

We claim as our invention:

1. A drying device for bulk goods comprising:
a chamber having a drying space therein,
a vibratory helical conveyor for conveying bulk goods through said drying space,
a body of water-immiscible liquid contained in said drying space, said liquid being lighter than water,
means for rendering said drying space gas-tight,
means for introducing an inert gas into said drying space, and
means for directing moisture displaced by said liquid to the bottom of said chamber for discharge therefrom.

2. A drying device according to claim 1 wherein said liquid is a saturated hydrocarbon, a cycloparaffin, or an aromatic hydrocarbon.

3. A drying device for bulk goods comprising:
a chamber having a drying space therein,
a vibratory helical conveyor for conveying bulk goods through said drying space,
a body of water-immiscible liquid contained in said drying space, said liquid being lighter than water,
at least the lower turns of said helical conveyor extend below the surface of said water-immiscible liquid,
means for rendering said drying space gas-tight,
means for introducing an inert gas into said drying space, and
means for directing moisture displaced by said liquid to the bottom of said chamber for discharge therefrom.

4. A drying device for bulk goods comprising:
a chamber having a drying space therein,
a vibratory helical conveyor for conveying bulk goods through said drying space, said helical conveyor having apertured flights thereon,
a body of water-immiscible liquid contained in said drying space, said liquid being lighter than water,
means for rendering said drying space gas-tight,
means for introducing an inert gas into said drying space, and
means for directing moisture displaced by said liquid to the bottom of said chamber for discharge therefrom.

5. A drying device for bulk goods comprising:
a chamber having a drying space therein,
a vibratory helical conveyor for conveying bulk goods through said drying space, said helical conveyor having some flights extending above the surface of the water-immiscible liquid,
a body of water-immiscible liquid contained in said drying space, said liquid being lighter than water,
means for rendering said drying space gas-tight,
means for introducing an inert gas into said drying space, and
means for directing moisture displaced by said liquid to the bottom of said chamber for discharge therefrom.

6. A drying device for bulk goods comprising:
a chamber having a drying space therein,
a vibratory helical conveyor for conveying bulk goods through said drying space,
a body of water-immiscible liquid contained in said drying space, said liquid being lighter than water,
means for rendering said drying space gas-tight,
means for introducing an inert gas into said drying space,
means for directing moisture displaced by said liquid to the bottom of said chamber for discharge therefrom, and
a spray means positioned to spray said water-immiscible liquid onto the goods on that portion of the conveyor which extends above the surface of said water-immiscible liquid.

7. A drying device according to claim 6 which includes a condensation means located above the surface of said water-immiscible liquid, and means for delivering condensate from said condensation means into said spray means.

8. A method of removing moisture from goods which comprises:
passing said goods together with an inert gas into a bath of water-immiscible liquid located in a gas-tight drying space, the water-immiscible liquid being lighter than water,
propelling said goods upwardly through said bath while vibrating the same, and
discharging the goods from above the level of said bath in said drying space.

9. The method of claim 8 which includes the step of spraying the goods with said liquid after the goods have left said bath and prior to discharge from said drying space.

* * * * *